US006826528B1

(12) United States Patent
Wu et al.

(10) Patent No.: US 6,826,528 B1
(45) Date of Patent: Nov. 30, 2004

(54) WEIGHTED FREQUENCY-CHANNEL BACKGROUND NOISE SUPPRESSOR

(75) Inventors: Duanpei Wu, San Jose, CA (US); Miyuki Tanaka, Tokyo (JP); Xavier Menendez-Pidal, Los Gatos, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 773 days.

(21) Appl. No.: 09/691,878

(22) Filed: Oct. 18, 2000

Related U.S. Application Data

(63) Continuation-in-part of application No. 09/176,178, filed on Oct. 21, 1998, now Pat. No. 6,230,122.

(60) Provisional application No. 60/160,842, filed on Oct. 21, 1999, and provisional application No. 60/099,599, filed on Sep. 9, 1998.

(51) Int. Cl.[7] ..... G10L 21/02

(52) U.S. Cl. ..... 704/226; 704/204; 704/233

(58) Field of Search ..... 704/233, 226, 704/227, 204

(56) References Cited

U.S. PATENT DOCUMENTS

| | | | | |
|---|---|---|---|---|
| 4,821,325 A | * | 4/1989 | Martin et al. | 704/253 |
| 4,831,551 A | | 5/1989 | Schalk et al. | 364/513.5 |
| 5,212,764 A | * | 5/1993 | Ariyoshi | 704/233 |
| 5,574,824 A | | 11/1996 | Slyh et al. | 395/2.35 |
| 5,617,508 A | | 4/1997 | Reaves | 395/2.42 |
| 5,706,394 A | | 1/1998 | Wynn | 395/2.28 |
| 5,727,072 A | | 3/1998 | Raman | 381/94.2 |
| 5,732,390 A | | 3/1998 | Katayanagi et al. | 704/227 |
| 5,749,068 A | | 5/1998 | Suzuki | 704/233 |
| 5,768,473 A | | 6/1998 | Eatwell et al. | 395/2.35 |
| 5,806,022 A | | 9/1998 | Rahim et al. | 704/205 |
| 5,806,025 A | | 9/1998 | Vis et al. | 704/226 |
| 6,230,122 B1 | * | 5/2001 | Wu et al. | 704/226 |

* cited by examiner

*Primary Examiner*—Richemond Dorvil
*Assistant Examiner*—Donald L. Storm
(74) *Attorney, Agent, or Firm*—Gregory J. Koerner; Simon & Koerner LLP

(57) ABSTRACT

A method for implementing a noise suppressor in a speech recognition system comprises a filter bank for separating source speech data into discrete frequency sub-bands to generate filtered channel energy, and a noise suppressor for weighting the frequency sub-bands to improve the signal-to-noise ratio of the resultant noise-suppressed channel energy. The noise suppressor preferably includes a noise calculator for calculating background noise values, a speech energy calculator for calculating speech energy values for each channel of the filter bank, and a weighting module for applying calculated weighting values to the projected channel energy to generate the noise-suppressed channel energy.

42 Claims, 8 Drawing Sheets

WEIGHTED FREQUENCY-CHANNEL BACKGROUND NOISE SUPPRESSOR

CROSS-REFERENCE TO RELATED APPLICATIONS

This application claims priority as a Continuation-in-Part application of U.S. patent application Ser. No. 09/176,178, entitled "Method For Suppressing Background Noise In A Speech Detection System," filed on Oct. 21, 1998, now U.S. Pat. No. 6,230,122. This application also relates to, and claims priority in, U.S. Provisional Patent Application No. 60/160,842, entitled "Method For Implementing A Noise Suppressor In A Speech Recognition System," filed on Oct. 21, 1999 Provisional Pat. Application Ser. No. 60/099,599 filed Sep. 9, 1995. The foregoing related applications are commonly assigned, and are hereby incorporated by reference.

BACKGROUND

1. Field of the Invention

This invention relates generally to electronic speech detection systems, and relates more particularly to a method for implementing a noise suppressor in a speech recognition system.

2. Description of the Background Art

Implementing an effective and efficient method for system users to interface with electronic devices is a significant consideration of system designers and manufacturers. Human speech recognition is one promising technique that allows a system user to effectively communicate with selected electronic devices, such as digital computer systems. Speech generally consists of one or more spoken utterances which each may include a single word or a series of closely-spaced words forming a phrase or a sentence. In practice, speech detection systems typically determine the endpoints (the beginning and ending points) of a spoken utterance to accurately identify the specific sound data intended for analysis.

Conditions with significant ambient background-noise levels present additional difficulties when implementing a speech detection system. Examples of such noisy conditions may include speech recognition in automobiles or in certain manufacturing facilities. In such user applications, in order to accurately analyze a particular utterance, a speech recognition system may be required to selectively differentiate between a spoken utterance and the ambient background noise.

Referring now to FIG. 1(*a*), an exemplary waveform diagram for one embodiment of noisy speech 112 is shown. In addition, FIG. 1(*b*) depicts an exemplary waveform diagram for one embodiment of speech 114 without noise. Similarly, FIG. 1(*c*) shows an exemplary waveform diagram for one embodiment of noise 116 without speech 114. In practice, noisy speech 112 of FIG. 1(*a*) is therefore typically comprised of several components, including speech 114 of FIG. (1(*b*) and noise 116 of FIG. 1(*c*). In FIGS. 1(*a*), 1(*b*), and 1(*c*), waveforms 112, 114, and 116 are presented for purposes of illustration only. The present invention may readily function and incorporate various other embodiments of noisy speech 112, speech 114, and noise 116.

An important measurement in speech detection systems is the signal-to-noise ratio (SNR) which specifies the amount of noise present in relation to a given signal. For example, the SNR of noisy speech 112 in FIG. 1(*a*) may be expressed as the ratio of noisy speech 112 divided by noise 116 of FIG. 1(*c*). Many speech detection systems tend to function unreliably in conditions of high background noise when the SNR drops below an acceptable level. For example, if the SNR of a given speech detection system drops below a certain value (for example, 0 decibels), then the accuracy of the speech detection function may become significantly degraded.

Various methods have been proposed for speech enhancement and noise suppression. For example, one known method for speech enhancement is Wiener filtering. Inverse filtering based on all-pole models has also been reported as a suitable method for noise suppression. However, the foregoing methods are not entirely satisfactory in certain relevant applications, and thus they may not perform adequately in particular implementations. From the foregoing discussion, it therefore becomes apparent that suppressing ambient background noise to improve the signal-to-noise ratio in a speech detection system is a significant consideration of system designers and manufacturers of speech detection systems.

SUMMARY OF THE INVENTION

In accordance with the present invention, a method is disclosed for suppressing background noise in a speech detection system. In one embodiment, a feature extractor in a speech detector initially receives noisy speech data that is preferably generated by a sound sensor, an amplifier and an analog-to-digital converter. In the preferred embodiment, the speech detector processes the noisy speech data in a series of individual data units called "windows" that each includes sub-units called "frames".

The feature extractor responsively filters the received noisy speech into a predetermined number of frequency sub-bands or channels using a filter bank to thereby generate filtered channel energy to a noise suppressor. The filtered channel energy is therefore preferably comprised of a series of discrete channels which the noise suppressor operates on concurrently.

Next, a noise calculator in the noise suppressor preferably calculates channel background noise values for each channel of the filter bank, and responsively stores the channel background noise values into a memory device. Similarly, a speech energy calculator in the noise suppressor preferably calculates speech energy values for each channel of the filter bank, and responsively stores the speech energy values into the memory device.

Then, a weighting module in the noise suppressor advantageously calculates individual weighting values for each calculated channel energy value. In a first embodiment, the weighting module calculates weighting values whose various channel values are related to the reciprocal of a channel average background noise variance value for the corresponding channel.

In a second embodiment, in order to reduce the dynamic range of the weighting procedure, the weighting module may calculate the individual weighting values as being equal to the reciprocal of a minimum variance of channel background noise for the corresponding channel. The weighting module therefore generates a total noise-suppressed channel energy that is the summation of each channel's channel energy value multiplied by that channel's calculated weighting value.

An endpoint detector then receives the noise-suppressed channel energy, and responsively detects corresponding speech endpoints. Finally, a recognizer receives the speech endpoints from the endpoint detector, and also receives feature vectors from the feature extractor, and responsively generates a recognition result using the endpoints and the feature vectors between the endpoints. The present invention thus efficiently and effectively implements a noise suppressor in a speech recognition system.

BRIEF DESCRIPTION OF THE DRAWINGS

FIG. 1(*b*) is an exemplary waveform diagram for one embodiment of speech energy without noise energy;

FIG. 1(*c*) is an exemplary waveform diagram for one embodiment of noise energy without speech energy;

DETAILED DESCRIPTION OF THE PREFERRED EMBODIMENT

The present invention relates to an improvement in speech recognition systems. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown, but is to be accorded the widest scope consistent with the principles and features described herein.

The present invention includes a method for implementing a noise suppressor in a speech recognition system that comprises a filter bank for separating source speech data into discrete frequency sub-bands to generate filtered channel energy, and a noise suppressor for weighting the frequency sub-bands to improve the signal-to-noise ratio of the resultant noise-suppressed channel energy. The noise suppressor preferably includes a noise calculator for calculating channel background noise values, and a weighting module for calculating and applying calculated weighting values to the filtered channel energy to generate the noise-suppressed channel energy.

Figure 1A:
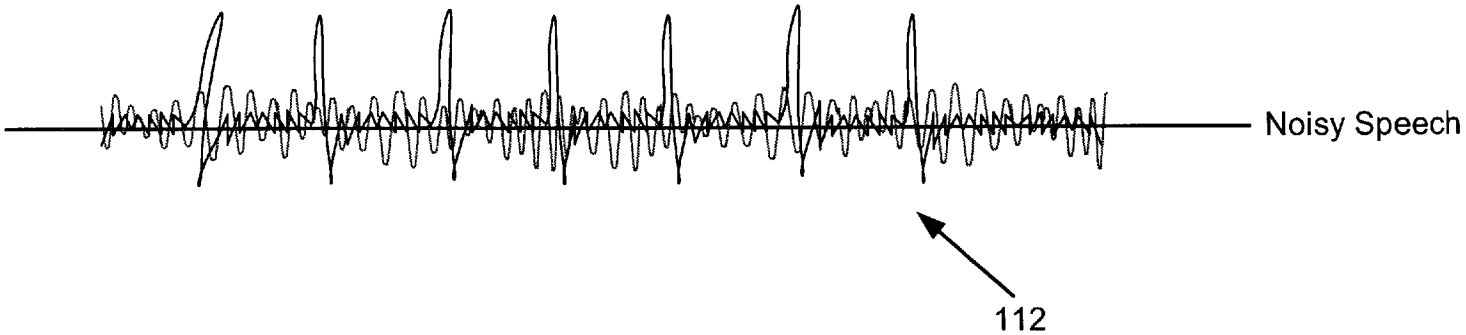
FIG. 1(*a*) is an exemplary waveform diagram for one embodiment of noisy speech energy.
Figure 1B:
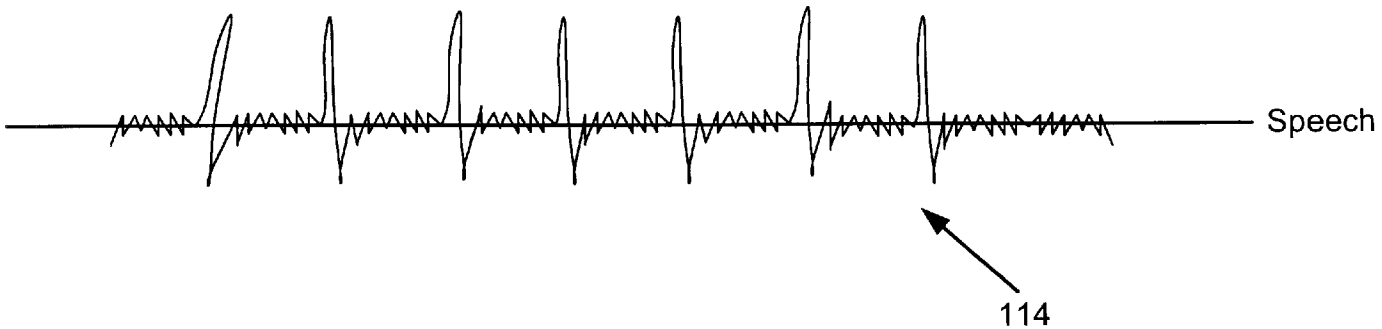
Figure 1C:
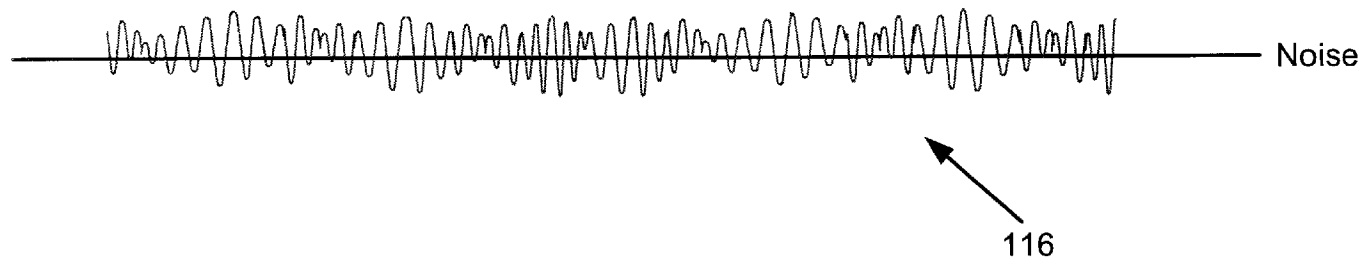
Figure 2:
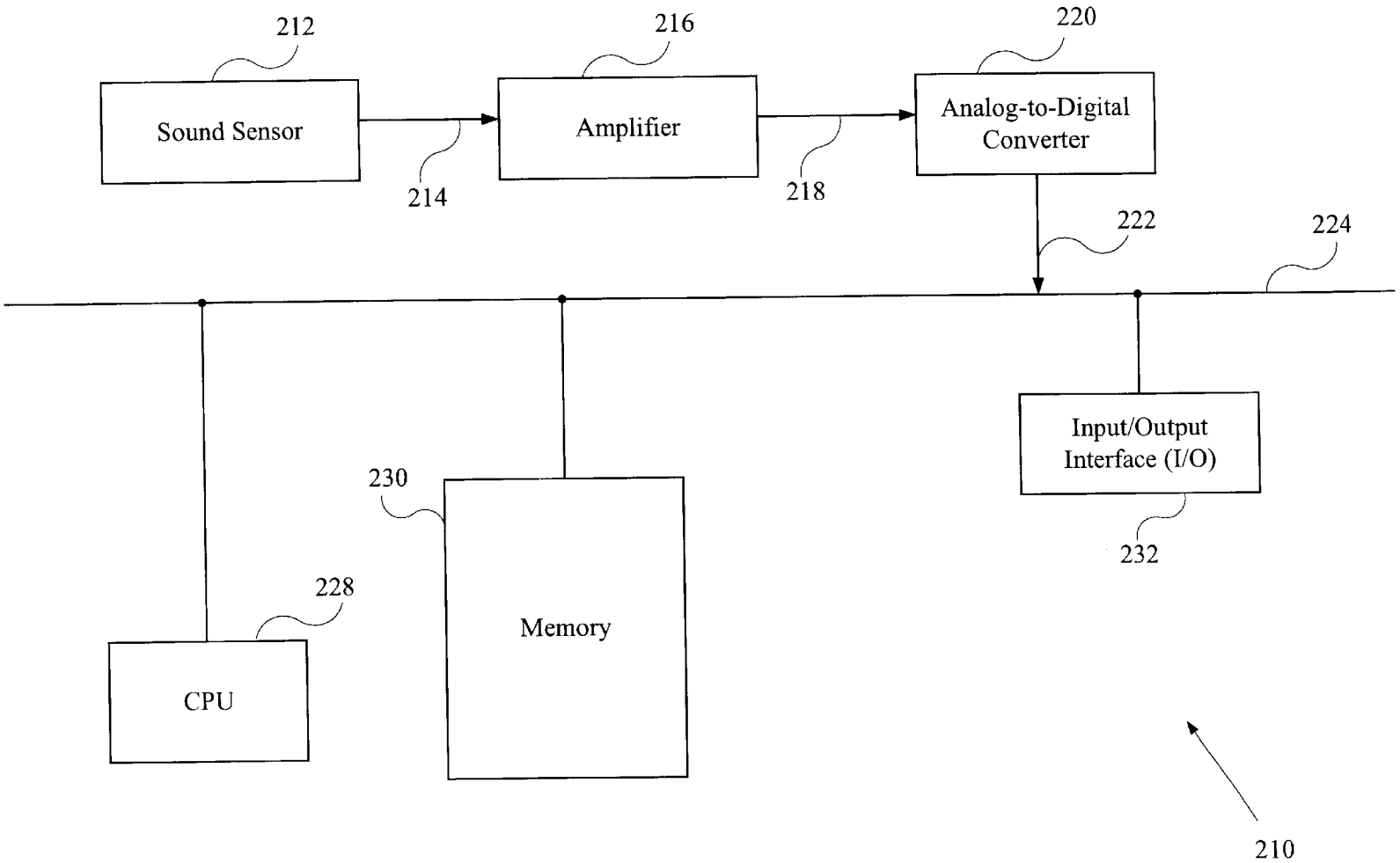
FIG. 2 is a block diagram of one embodiment for a computer system, in accordance with the present invention.

Referring now to FIG. 2, a block diagram of one embodiment for a computer system 210 is shown, in accordance with the present invention. The FIG. 2 embodiment includes a sound sensor 212, an amplifier 216, an analog-to-digital converter 220, a central processing unit (CPU) 228, a memory 230, and an input/output device 232.

In operation, sound sensor 212 detects ambient sound energy and converts the detected sound energy into an analog speech signal which is provided to amplifier 216 via line 214. Amplifier 216 amplifies the received analog speech signal and provides an amplified analog speech signal to analog-to-digital converter 220 via line 218. Analog-to-digital converter 220 then converts the amplified analog speech signal into corresponding digital speech data and provides the digital speech data via line 222 to system bus 224.

CPU 228 may then access the digital speech data on system bus 224 and responsively analyze and process the digital speech data to perform speech detection according to software instructions contained in memory 230. The operation of CPU 228 and the software instructions in memory 230 are further discussed below in conjunction with FIGS. 3–8. After the speech data is processed, CPU 228 may then advantageously provide the results of the speech detection analysis to other devices (not shown) via input/output interface 232.

Figure 3:
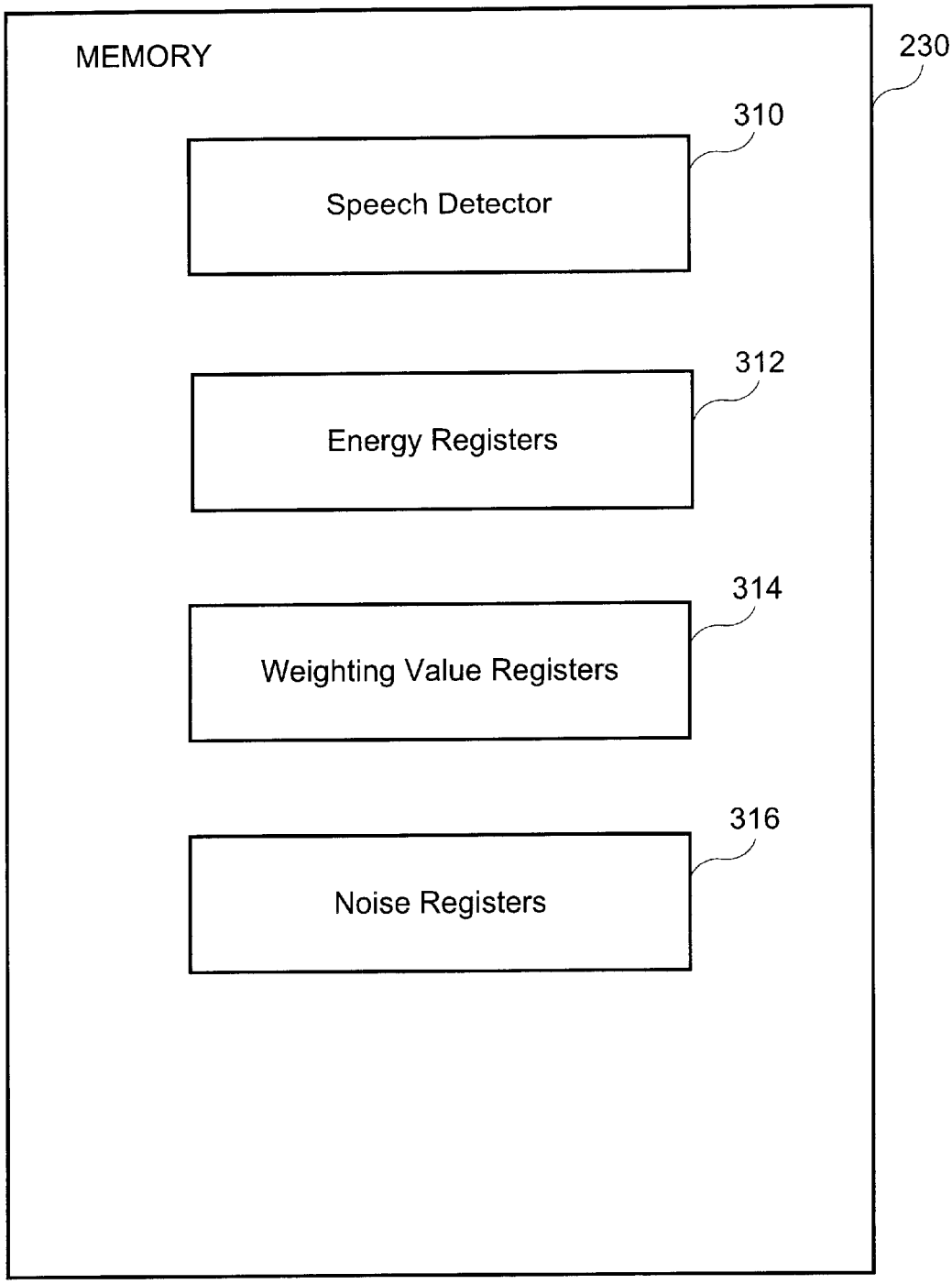
FIG. 3 is a block diagram of one embodiment for the memory of FIG. 2, in accordance with the present invention.

Referring now to FIG. 3, a block diagram of one embodiment for the FIG. 2 memory 230 is shown. Memory 230 may alternatively comprise various storage-device configurations, including Random-Access Memory (RAM) and non-volatile storage devices such as floppy-disks or hard disk-drives. In the FIG. 3 embodiment, memory 230 includes a speech detector 310, energy registers 312, weighting value registers 314, and noise registers 316.

In the preferred embodiment, speech detector 310 includes a series of software modules which are executed by CPU 228 to analyze and detect speech data, and which are further described below in conjunction with FIG. 4. In alternate embodiments, speech detector 310 may readily be implemented using various other software and/or hardware configurations. Energy registers 312, weighting value registers 314, and noise registers 316 contain respective variable values which are calculated and utilized by speech detector 310 to suppress background noise according to the present invention. The utilization and functionality of energy registers 312, weighting value registers 314, and noise registers 316 are further described below in conjunction with FIGS. 6 through 8.

Figure 4:
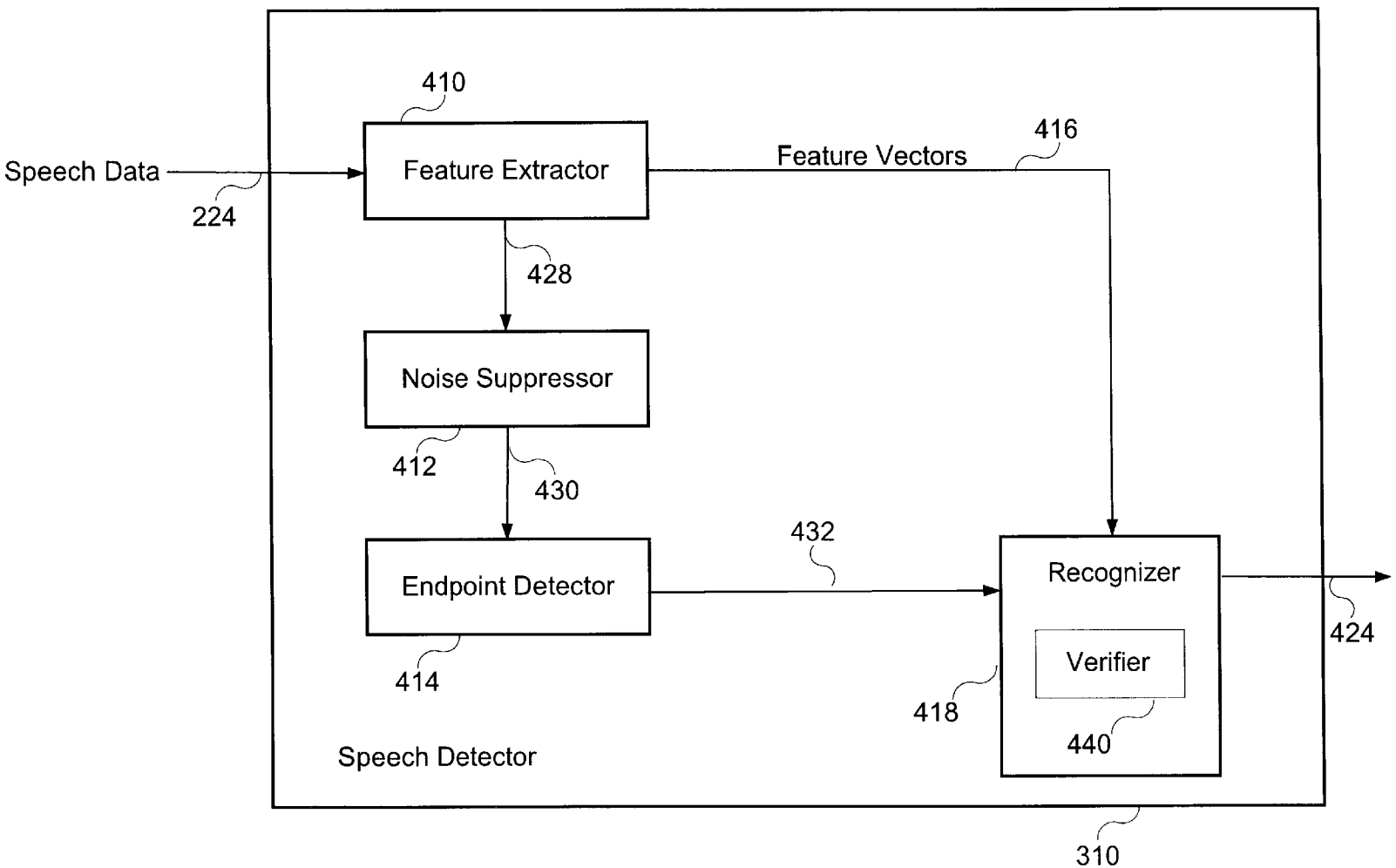
FIG. 4 is a block diagram of one embodiment for the speech detector of FIG. 3.

Referring now to FIG. 4, a block diagram of one embodiment for the FIG. 3 speech detector 310 is shown. In the FIG. 3 embodiment, speech detector 310 includes a feature extractor 410, a noise suppressor 412, an endpoint detector 414, and a recognizer 418.

In operation, analog-to-digital converter 220 (FIG. 2) provides digital speech data to feature extractor 410 within speech detector 310 via system bus 224. A filter bank in feature extractor 410 then receives the speech data and responsively generates channel energy which is provided to noise suppressor 412 via path 428. In the preferred embodiment, the filter bank in feature extractor 410 is a mel-frequency scaled filter bank which is further described below in conjunction with FIG. 5. The channel energy from the filter bank in feature extractor 410 is also provided to a feature vector calculator in feature extractor 410 to generate feature vectors which are then provided to recognizer 418 via path 416. In the preferred embodiment, the feature vector calculator is a mel-scaled frequency capture (mfcc) feature vector calculator.

In accordance with the present invention, noise suppressor 412 responsively processes the received channel energy to suppress background noise. Noise suppressor 412 then generates noise-suppressed channel energy to endpoint detector via path 430. The functionality and operation of noise suppressor 412 is further discussed below in conjunction with FIGS. 6 through 8.

Endpoint detector 414 analyzes the noise-suppressed channel energy received from noise suppressor 412, and responsively determines endpoints (beginning and ending points) for the particular spoken utterance represented by the noise-suppressed channel energy received via path 430. Endpoint detector 414 then provides the calculated endpoints to recognizer 418 via path 432. The operation of endpoint detector 414 is further discussed in U.S. patent application Ser. No. 08/957,875, entitled "Method For Implementing A Speech Recognition System For Use During Conditions With Background Noise," filed on Oct. 20, 1997, now U.S. Pat. No. 6,216,103, which is hereby incorporated by reference.

Finally, recognizer 418 receives feature vectors via path 416 and endpoints via path 432, and responsively performs a speech detection procedure to advantageously generate a speech detection result to CPU 228 via path 424. Verifier 440 preferably checks the segment of an utterance between the identified endpoints to determine whether the segment is a speech signal. This decision may be made based on the signal characteristics and a confidence index preferably generated using a confidence measure technique and a garbage modeling technique. Verifier 440 responsively generates an abort/confirm signal to recognizer 418. The foregoing confidence measure technique is further discussed in U.S. patent application Ser. No. 09/553,985, entitled "System And Method For Speech Verification Using A Confidence Measure," filed on Apr. 20, 2000, now U.S. Pat. No. 6,473,735, which is hereby incorporated by reference. Similarly, the foregoing garbage modeling technique is further discussed in U.S. patent application Ser. No. 09,691,877, entitled "System And Method For Speech Verification Using Out-Of-Vocabulary Models," filed on Oct. 18, 2000, which is hereby incorporated by reference.

Figure 5:
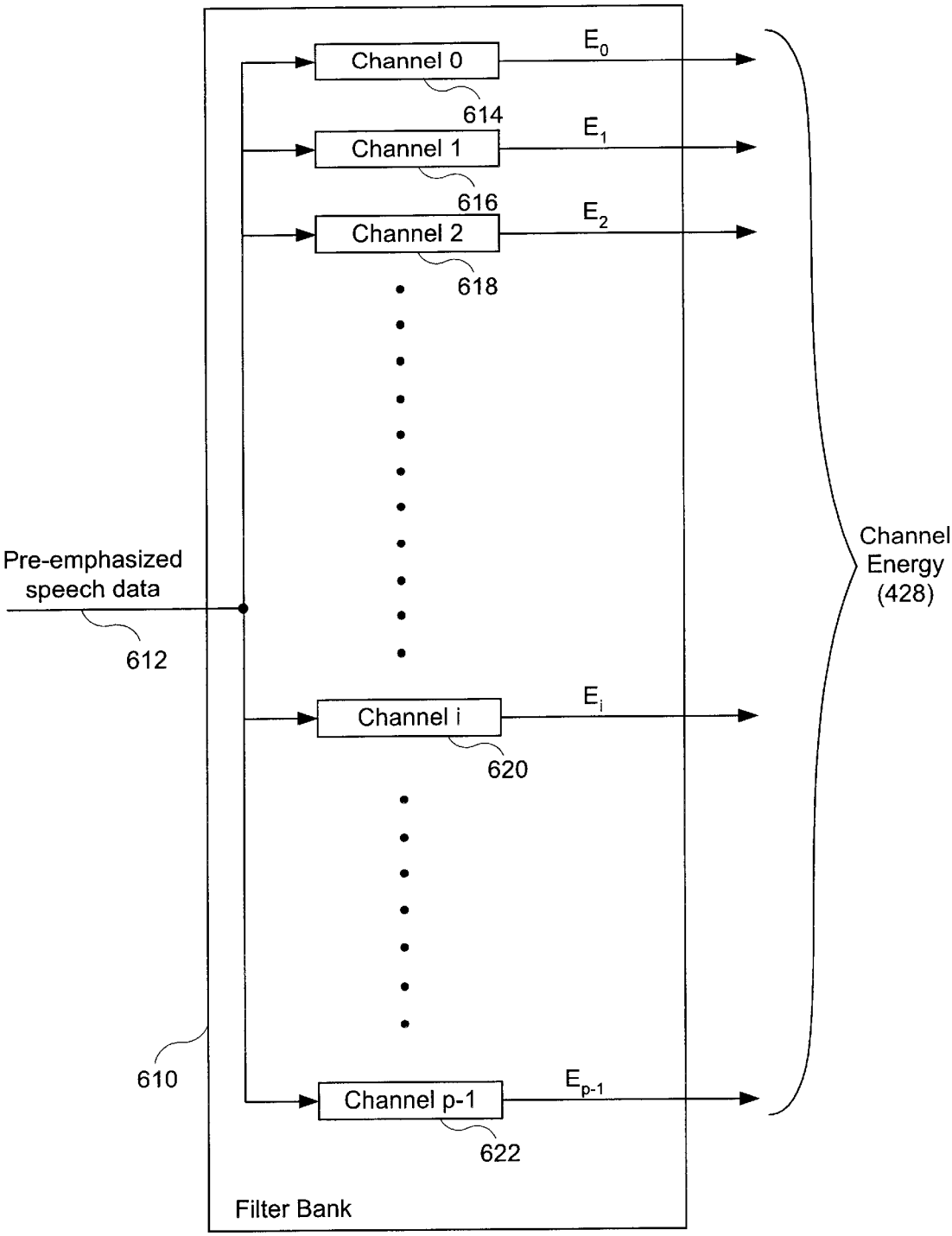
FIG. 5 is a schematic diagram of one embodiment for the filter bank of the FIG. 4 feature extractor.

Referring now to FIG. 5, a schematic diagram of one embodiment for the filter bank 610 of feature extractor 410 (FIG. 4) is shown. In the preferred embodiment, filter bank 610 is a mel-frequency scaled filter bank with "p" channels (channel 0 (614) through channel p−1 (622)). In alternate embodiments, various other implementations of filter bank 610 are equally possible.

In operation, filter bank 610 receives pre-emphasized speech data via path 612, and provides the speech data in parallel to channel 0 (614) through channel p−1 (622). In response, channel 0 (614) through channel p−1 (622) generate respective channel energies $E_0$ through $E_p$ which collectively form the channel energy provided to noise suppressor 412 via path 428 (FIG. 4).

Filter bank 610 thus processes the speech data received via path 612 to generate and provide filtered channel energy to noise suppressor 412 via path 428. Noise suppressor 412 may then advantageously suppress the background noise contained in the received channel energy, in accordance with the present invention.

Figure 6:
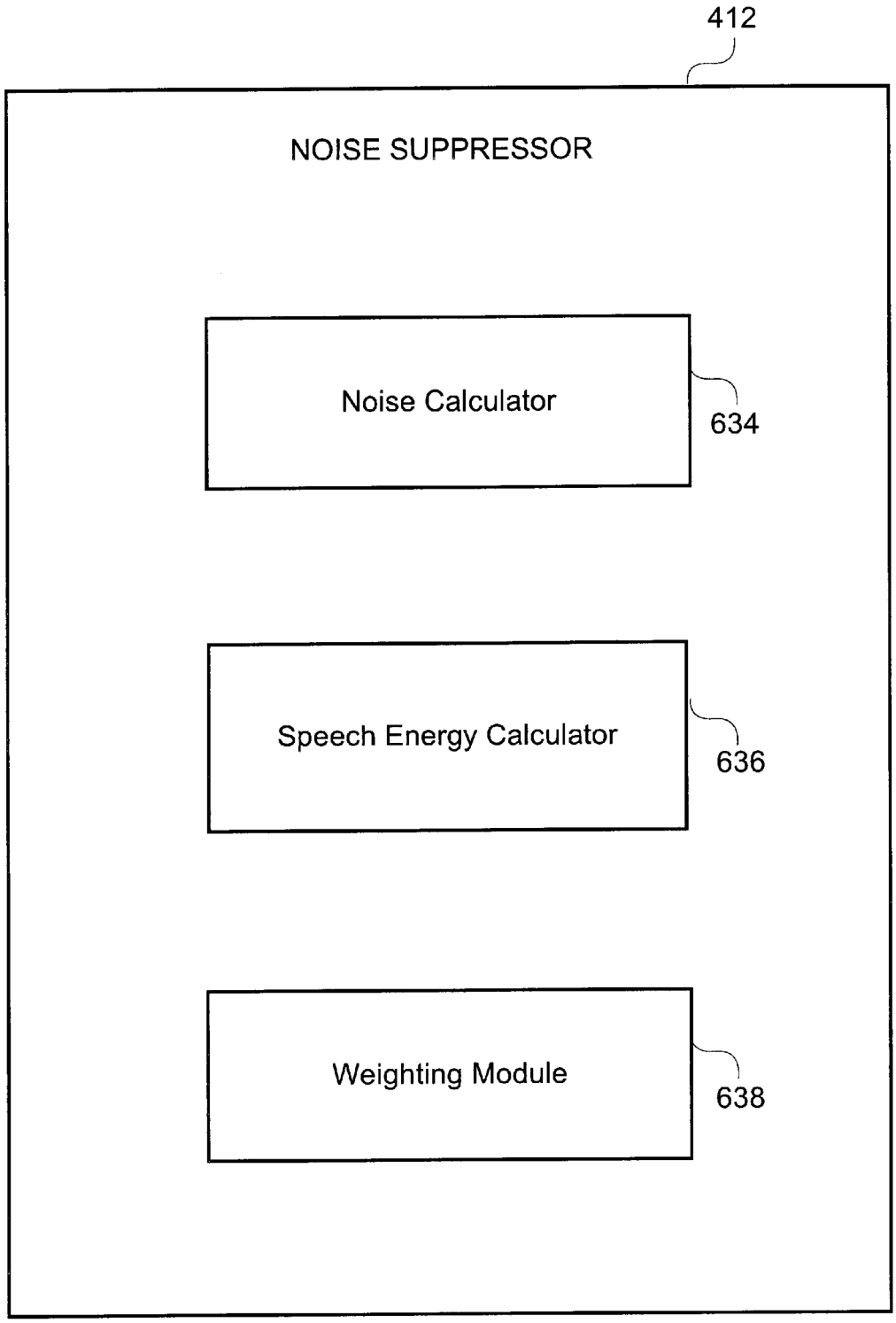
FIG. 6 is a block diagram of one embodiment for the noise suppressor of FIG. 4, in accordance with the present invention.

Referring now to FIG. 6, a block diagram of one embodiment for the FIG. 4 noise suppressor 412 is shown, in accordance with the present invention. In the FIG. 6 embodiment, noise suppressor 412 preferably includes a noise calculator 634, a speech energy calculator 636, and a weighting module 638.

In the FIG. 6 embodiment, noise suppressor 412 preferably utilizes noise calculator 634 to identify and calculate channel background noise values for each channel of filter bank 610. Similarly, noise suppressor 412 preferably utilizes speech energy calculator 636 to calculate speech energy values for each channel of filter bank 610. Noise suppressor 412 then preferably uses weighting module 638 to weight the channel speech energy from filter bank 610 with weighting values adapted to the channel background noise data to thereby advantageously increase the signal-to-noise ratio (SNR) of the channel energy. In order to obtain a high overall SNR, the channel energy from those channels with a high SNR should be weighted highly to produce the noise-suppressed channel energy.

In other words, the weighting values calculated and applied by weighting module 638 are preferably proportional to the SNRs of the respective channel energies. In the preferred operation of the FIG. 6 embodiment, noise suppressor 412 initially determines the channel energy for each of the channels transmitted from filter bank 610, and preferably stores corresponding channel energy values into energy registers 312 (FIG. 3). Noise suppressor 412 also determines channel background noise values for each of the channels of filter bank 610, and preferably stores the channel background noise values into noise registers 316.

Weighting module 638 may then advantageously access the channel energy values and the channel background noise values to calculate weighting values that are preferably stored into weighting value registers 314. Finally, weighting module 638 applies the calculated weighting values to the corresponding channel energy values to generate noise-suppressed channel energy to endpoint detector 414 for use as endpoint detection parameters, in accordance with the present invention.

One embodiment for the performance of noise suppressor 412 may be illustrated by the following discussion. Let n denote an uncorrelated additive random noise vector from the background noise of the channel energy, let s be a random speech feature vector from the channel energy, and let y stand for a random noisy speech feature vector from the channel energy, all with dimension "p" to indicate the number of channels. Therefore, relationship of the foregoing variables may be expressed by the following equation:

$$y=s+n$$

Although the present invention may utilize any appropriate and compatible weighting scheme, weighting module 638 of the FIG. 6 embodiment primarily utilizes several principal weighting techniques. Let q denote the estimated average energy vector of the random speech vector s from the channel energy from filter bank 610, and let q be defined by the following formula.

$$q=[\beta_0, \beta_1, \ldots, \beta_{p-1}]^T$$

Furthermore, let λ be the estimated average energy vector of background noise n from the channel energy from filter bank 610, and let λ be defined by the following formula.

$$\lambda=[\lambda_0, \lambda_1, \ldots \lambda_{p-1}]^T$$

Then the signal-to-noise ratio (SNR) "$r_i$" for channel "i" may be defined as $r_i=\beta_i/\lambda_i$ i=0, 1, . . . , p−1

In a one embodiment, weighting module 638 provides a method for calculating weighting values "w" whose various channel values are directly proportional to the SNR for the corresponding channel. Weighting module 638 may thus calculate weighting values using the following formula.

$$w_i=(r_i)^{\alpha}$$

i=0, 1, . . . p−1 where $\alpha$ is a selectable constant value, and "i" designated a selected channel of filter bank 610.

In another embodiment, in order to achieve an implementation of ¢reduced complexity and computational requirements, weighting module 638 sets the variance vector of the speech q to the unit vector, and sets the value $\alpha$ to 1. The weighting value for a given channel thus becomes equal to the reciprocal of the background noise for that channel. According to the second embodiment of weighting module 638, the weighting values "$w_i$" may be defined by the following formula.

$$w_i=1/\lambda_i$$

i=0, 1, . . . p−1 where "$\lambda_i$" is the background noise for a given channel "i".

Weighting module 638 therefore generates noise-suppressed channel energy that is the summation of each channel energy value multiplied by that channel's calculated weighting value "$w_i$". The total noise-suppressed channel energy "$E_T$" may therefore be defined by the following formula.

$$E_T=\Sigma w_i{}^*E_i$$

i=0, 1, . . . p−1

Figure 7:
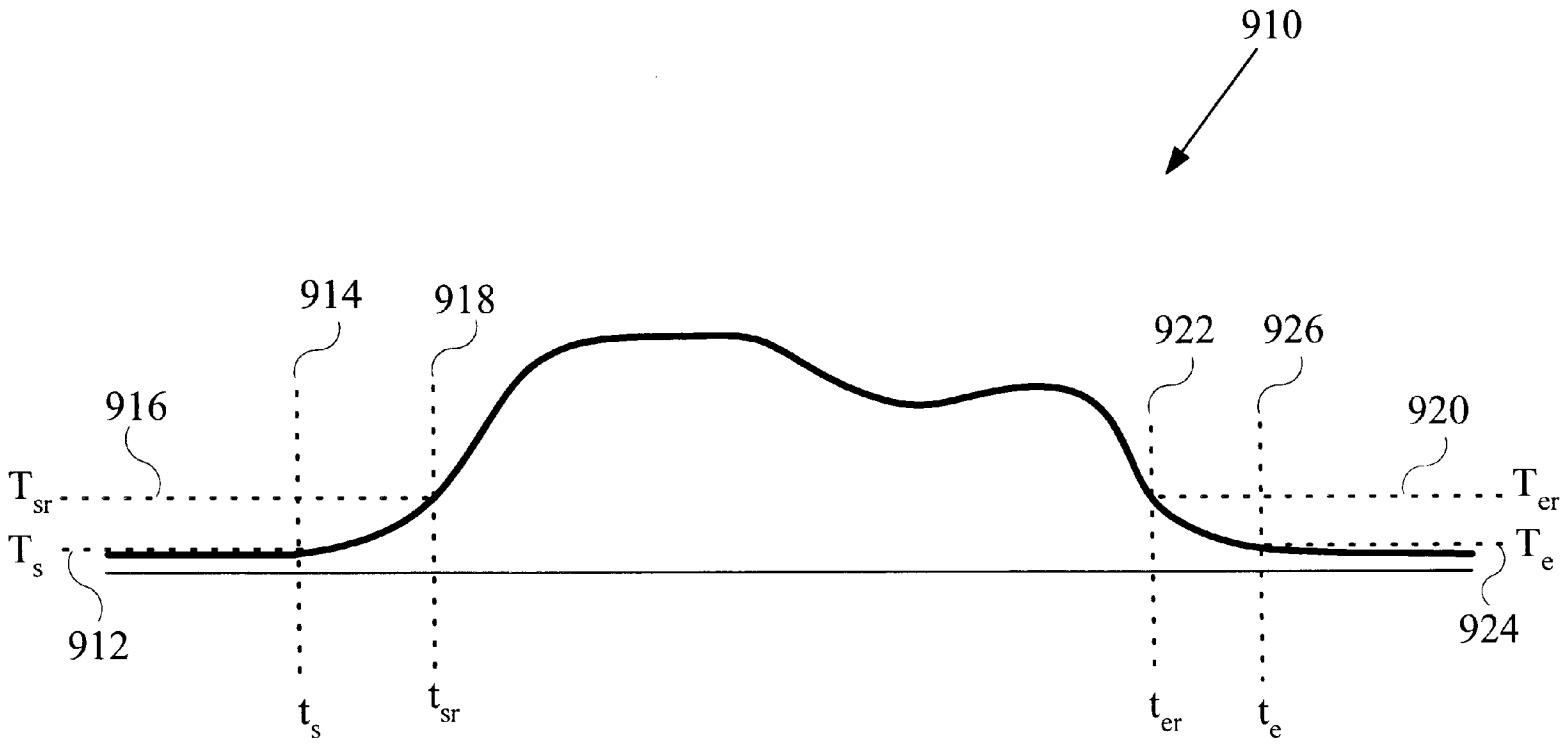
FIG. 7 is a waveform diagram of one exemplary embodiment for detecting speech energy, in accordance with the present invention.

Referring now to FIG. 7, a diagram of exemplary speech energy 910 is shown, including a reliable island and four thresholds that may be referenced when calculating channel background noise values according to one embodiment of the present invention. Speech energy 910 represents an exemplary spoken utterance which has a beginning point $t_s$ shown at time 914 and an ending point $t_e$ shown at time 926. The waveform of the FIG. 7 speech energy 910 is presented for purposes of illustration only and may alternatively comprise various other waveforms.

Speech energy 910 also includes a reliable island region which has a starting point $t_{sr}$ shown at time 918, and a stopping point $t_{er}$ shown at time 922. In operation, speech detector 310 repeatedly recalculates the foregoing thresholds ($T_s$ 912, $T_e$ 920, $T_{sr}$ 916, and $T_{er}$ 920) in real time. One method for calculating the foregoing thresholds ($T_{S\ 912}$, $T_e$ 920, $T_{sr}$ 916, and $T_{er}$ 920) is further discussed in co-pending U.S. patent application Ser. No. 08/957,875, entitled "Method For Implementing A Speech Recognition System For Use During Conditions With Background Noise," filed on Oct. 20, 1997, which has previously been incorporated herein by reference.

In the FIG. 7 embodiment, noise calculator 634 of noise suppressor 412 preferably calculates channel background noise values during a silent segment of speech energy which is defined as a segment of speech energy that has a relatively low energy value. In one embodiment, the silent segment used to calculate channel background noise values preferably is located in a silent segment that has signal energy below an ending noise-calculation threshold, and that also has signal energy below a beginning noise-calculation threshold.

In the FIG. 7 embodiment, the ending noise-calculation threshold may be expressed by the following formula.

$$T_e+0.125(T_{er}-T_e)$$

Similarly, in the FIG. 7 embodiment, the beginning noise-calculation threshold may be expressed by the following formula.

$$T_s+0.125(T_{sr}-Ts)$$

In the FIG. 7 embodiment, for each channel of filter bank 610, the respective weighting values may be reciprocally proportional to the variance of channel energy or channel average background noise. In one embodiment, channel average background noise "$N_i(m)$" for channel m at frame i may be calculated by using the following iterative equation.

$$N_i(m)=\alpha N_{i-1}(m)+(1-\alpha)y_i(m)$$

m=0, 1, . . . , M−1 where $y_i(m)$ is the signal energy during a silent segment of channel m at frame i, M is the total number of frequency channels, and a is a forgetting factor. In one embodiment, a may be equal to 0.985, which is equivalent to a window size of 145 frames.

In another embodiment, channel average background noise may utilize non-linear spectrum subtraction (NSS) to advantageously remove a mean value to produce a channel average background noise variance value "$V_i(m)$" for channel m at frame i. Various principals of spectral subtraction techniques are further discussed in "Adapting A HMM-Based Recogniser For Noisy Speech Enhanced By Spectral Subtraction," by J. A. Nolazco and S. J. Young, April 1993, Cambridge University (CUED/F-INFENG/TR.123), which is hereby incorporated by reference.

In accordance with the present invention, the channel average background noise variance value "$V_i(m)$" for channel m at frame i may be calculated using the following iterative equation.

$$V_i(m)=\alpha V_{i-1}(m)+(1-\alpha)|y_i(m)-N_i(m)|$$

m=0, 1, . . . , M−1 where $y_i(m)$ is the signal energy during a silent segment of channel m at frame i, $N_i(m)$ is the channel average background noise value calculated above, said M is the total number of frequency channels, and $\alpha$ is a forgetting factor. In one embodiment, $\alpha$ may be equal to 0.985, which is equivalent to a window size of 145 frames.

In the FIG. 7 embodiment, the weighting value $w_i(m)$ for a given channel of filter bank 610 may then preferably be set to the reciprocal of the channel average background noise variance value according to the following formula.

$$w_i(m)=1/V_i(m)$$

However, in certain embodiments, a saturation limit may be utilized to advantageously reduce the dynamic range of the weighting procedure by utilizing a different formula to calculate weighting values in certain instances where $V_i(m)$ is less than a pre-determined minimum value (MINV). In one embodiment, MINV is preferably equal to 0.00013.

If the channel average background noise variance value $V_i(m)$ is less than MINV, then the weighting value $w_i(m)$ may be calculated according to the following formula.

$$w_i(m)=1/MINV$$

where MINV is the minimum variance of channel background noise. MINV thus controls the gain to be used when speech is clean in corresponding channels of filter bank 610.

In accordance with the present invention, weighting module 638 of noise suppressor 412 may then apply the calculated weighting values to respective corresponding channel energies to produce noise-suppressed channel energy for use by endpoint detector 414. Alternately, weighting module 638 may supply the weighting values to endpoint detector 414 which may responsively utilize the weighting values to calculate endpoint detection parameters according to the following formula.

$$DTF(i) = \sum_{m=0}^{M-1} y_i(m) w_i(m)$$

where $w_i(m)$ is a respective weighting value, $y_i(m)$ is channel signal energy of channel m at frame i, and M is the total number of channels of filter bank 610.

Figure 8:
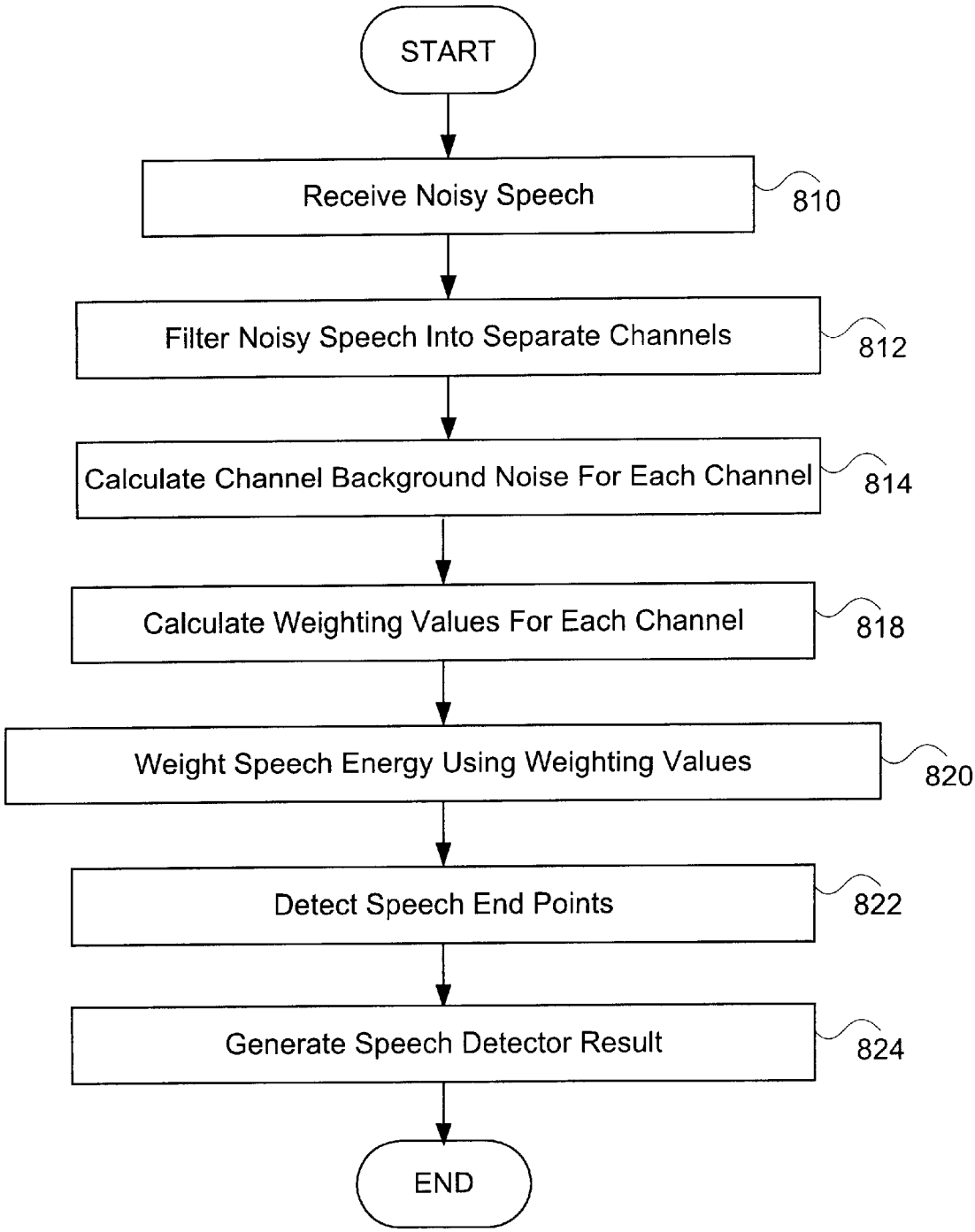
FIG. 8 is a flowchart for one embodiment of method steps for suppressing background noise in a speech detection system, in accordance with the present invention.

Referring now to FIG. 8, a flowchart for one embodiment of method steps for suppressing background noise in a speech detection system is shown, in accordance with the present invention. In step 810 of the FIG. 8 embodiment, feature extractor 410 of speech detector 310 initially receives noisy speech data that is preferably generated by sound sensor 212, and that is then processed by amplifier 216 and analog-to-digital converter 220. In the preferred embodiment, speech detector 310 processes the noisy speech data in a series of individual data units called "windows" that each include sub-units called "frames".

In step 812, feature extractor 410 filters the received noisy speech into a predetermined number of frequency sub-bands or channels using a filter bank 610 to thereby generate filtered channel energy to a noise suppressor 412. The filtered channel energy is therefore preferably comprised of a series of discrete channels, and noise suppressor 412 operates on each channel.

In step 814, a noise calculator 634 preferably identifies and calculates channel background noise values for each channel of filter bank 610, and responsively stores the channel background noise values into memory 230. Several techniques for identifying and calculating channel background noise values are discussed above in conjunction with FIGS. 6 and 7. In alternate embodiments, other techniques for determining channel background noise values are equally contemplated for use with the present invention.

Next, in step 818, a weighting module 638 in noise suppressor 412 calculates weighting values for each channel of the channel energy. In one embodiment, weighting module 638 calculates weighting values whose various channel values are directly proportional to the SNR for the corresponding channel. For example, the weighting values may be equal to the corresponding channel's SNR raised to a selectable exponential power.

In another embodiment, weighting module 638 calculates the individual weighting values as being equal to the reciprocal of the channel background noise for that corresponding channel. In step 820, weighting module 638 then generates noise-suppressed channel energy that is the sum of each channel's channel energy value multiplied by that channel's calculated weighting value.

In step 822, an endpoint detector 414 receives the noise-suppressed channel energy, and responsively detects corresponding speech endpoints. Finally, in step 824, a recognizer 418 receives the speech endpoints from endpoint detector 414 and feature vectors from feature extractor 410, and responsively generates a result signal from speech detector 310.

The invention has been explained above with reference to a preferred embodiment. Other embodiments will be apparent to those skilled in the art in light of this disclosure. For example, the present invention may readily be implemented using configurations and techniques other than those described in the preferred embodiment above. Additionally, the present invention may effectively be used in conjunction with systems other than the one described above as the preferred embodiment. Therefore, these and other variations upon the preferred embodiments are intended to be covered by the present invention, which is limited only by the appended claims.

What is claimed is:

1. A system for suppressing background noise in audio data, comprising:

a detector configured to perform a manipulation process on said audio data, said detector including a filter bank that generates filtered channel energy by separating said audio data into discrete frequency channels, said detector including a weighting module that weights selected components of said audio data to suppress said background noise, said weighting module generating noise-suppressed channel energy by applying separate weighting values directly to each of said discrete frequency channels of said filtered channel energy, said separate weighting values being related to background noise values of said discrete frequency channels; and a processor coupled to said system to control said detector for suppressing said background noise.

2. The system of claim 1 wherein said audio data includes speech information.

3. The system of claim 2 wherein said detector comprises a speech detector that includes program instructions which are stored in a memory device coupled to said processor, said speech detector weighting said selected components of said audio data to suppress said background noise.

4. The system of claim 3 wherein said speech information includes digital source speech data that is provided to said speech detector by an analog sound sensor and an analog-to-digital converter.

5. The system of claim 4 wherein said speech detector comprises a noise suppressor, said noise suppressor including a noise calculator, a speech energy calculator, and said weighting module.

6. A system for suppressing background noise in audio data, comprising:

a detector configured to perform a manipulation process on said audio data that includes digital source speech data provided to said speech detector by an analog sound sensor and an analog-to-digital converter, said detector including a filter bank that generates filtered channel energy by separating said digital source speech data into discrete frequency channels, said detector including a speech detector with program instructions that are stored in a memory device, said speech detector including a noise suppressor with a noise calculator, a speech energy calculator, and a weighting module, said speech detector weighting selected components of said audio data to suppress said background noise, said noise calculator calculating background noise values during a silent segment of said audio data, said silent segment being located below an ending noise-calculation threshold that is expressed by the formula:

$$T_e + 0.125(T_{er} - T_e)$$

where $T_e$ is an ending threshold of said audio data and $T_{er}$ is an ending threshold of a reliable island in said audio data; and a processor coupled to said system to control said detector for suppressing said background noise.

7. A system for suppressing background noise in audio data, comprising:

a detector configured to perform a manipulation process on said audio data that includes digital source speech data provided to said speech detector by an analog sound sensor and an analog-to-digital converter, said detector including a filter bank that generates filtered channel energy by separating said digital source speech data into discrete frequency channels, said detector including a speech detector with program instructions that are stored in a memory device, said speech detector including a noise suppressor with a noise calculator, a speech energy calculator, and a weighting module, said speech detector weighting selected components of said audio data to suppress said background noise, said noise calculator calculating background noise values during a silent segment of said audio data, said silent segment being located below a beginning noise-calculation threshold that is expressed by the formula:

$$T_s+0.125(T_{sr}-T_s)$$

where $T_s$ is a beginning threshold of said audio data and $T_{sr}$ is a beginning threshold of a reliable island in said audio data; and a processor coupled to said system to control said detector for suppressing said background noise.

8. The system of claim 5 wherein said noise calculator derives a channel average background noise value "$N_i(m)$" for a channel m at a frame i by using an iterative equation $$N_i(m)=\alpha N_{i-1}(m)+(1-\alpha)y_i(m)$$

m=0, 1, . . . , M−1 where said $y_i(m)$ is a signal energy during a silent segment of said channel m at said frame i, said M is a total number of said discrete frequency channels, and said $\alpha$ is a forgetting factor.

9. The system of claim 8 wherein A system for suppressing background noise in audio data, comprising:

a detector configured to perform a manipulation process on said audio data that includes digital source speech data provided to said speech detector by an analog sound sensor and an analog-to-digital converter, said detector including a filter bank that generates filtered channel energy by separating said digital source speech data into discrete frequency channels, said detector including a speech detector with program instructions that are stored in a memory device, said speech detector including a noise suppressor with a noise calculator, a speech energy calculator, and a weighting module, said speech detector weighting selected components of said audio data to suppress said background noise, said noise calculator deriving a channel average background noise value "$N_i(m)$" for a channel m at a frame i by using an iterative equation $$N_i(m)=\alpha N_{i-1}(m)+(1-\alpha)y_i(m)$$

m=0, 1, . . . , M−1 where said $y_i(m)$ is a signal energy during a silent segment of said channel m at said frame i, said M is a total number of said discrete frequency channels, and said a is a forgetting factor, said $\alpha$ being equal to 0.985 which is equivalent to a window size of 145 frames; and a processor coupled to said system to control said detector for suppressing said background noise.

10. The system of claim 5 wherein A system for suppressing background noise in audio data, comprising:

a detector configured to perform a manipulation process on said audio data that includes digital source speech data provided to said speech detector by an analog sound sensor and an analog-to-digital converter, said detector including a filter bank that generates filtered channel energy by separating said digital source speech data into discrete frequency channels, said detector including a speech detector with program instructions that are stored in a memory device, said speech detector including a noise suppressor with a noise calculator, a speech energy calculator, and a weighting module, said speech detector weighting selected components of said audio data to suppress said background noise, said noise calculator utilizing a non-linear spectrum subtraction procedure that removes a mean value and produces a channel average background noise variance value "$V_i(m)$" for a channel m at a frame i, said channel average background noise variance value "$V_i(m)$" for said channel m at said frame i being calculated using an iterative equation $$V_i(m)=\alpha V_{i-1}(m)+(1-\alpha)|y_i(m)-N_i(m)|$$

m=0, 1, . . . , M−1 where said $y_i(m)$ is a signal energy during a silent segment of said channel m at said frame i, said $N_i(m)$ is a channel average background noise value, said M is a total number of said discrete frequency channels, and said a is a forgetting factor; and a processor coupled to said system to control said detector for suppressing said background noise.

11. The system of claim 10 wherein said a is equal to 0.985 which is equivalent to a window size of 145 frames.

12. A system for suppressing background noise in audio data, comprising:

a detector configured to perform a manipulation process on said audio data that includes digital source speech data provided to said speech detector by an analog sound sensor and an analog-to-digital converter, said detector including a filter bank that generates filtered channel energy by separating said digital source speech data into discrete frequency channels, said detector including a speech detector with program instructions that are stored in a memory device, said speech detector including a noise suppressor with a noise calculator, a speech energy calculator, and a weighting module, said speech detector weighting selected components of said audio data to suppress said background noise, said weighting module generating noise-suppressed channel energy by applying separate weighting values to each of said discrete frequency channels of said filtered channel energy, said separate weighting values being related to background noise values of said discrete frequency channels; and a processor coupled to said system to control said detector for suppressing said background noise.

13. The system of claim 12 wherein said noise-suppressed channel energy "$E_T$" equals a summation of said filtered channel energy from each of said discrete frequency channels "$E_i$" multiplied by a corresponding one of said weighting values "$w_i$".

14. The system of claim 13 wherein said noise-suppressed channel energy "$E_T$" is defined by a formula:

$$E_T=\Sigma w_i{*}E_i$$

i=0, 1, . . . p−1 where said $E_i$ is a channel energy of said discrete frequency channels.

15. The system of claim 12 wherein said weighting module calculates a weighting value "$w_i(m)$" for said channel "i" using a formula $$w_i(m)=1/V_i(m)$$

where "$V_i(m)$" is a channel average background noise variance value for said channel "i" from said filter bank.

16. The system of claim 12 wherein said weighting module calculates a weighting value "$w_i(m)$" for said channel "i" using a formula $$w_i(m)=1/MINV$$

where MINV is a minimum variance of channel background noise, said MINV implementing a saturation limit to reduce a dynamic range of said weighting value "$w_i(m)$" when a channel average background noise variance value "$V_i(m)$" is less than said MINV.

17. The system of claim 16 wherein said MINV is equal to one of a value between 0.0001 and 0.0002, and a value equal to 0.00013.

18. The system of claim 12 wherein an endpoint detector analyzes said noise-suppressed channel energy to generate an endpoint signal.

19. The system of claim 18 wherein said endpoint detector calculates endpoint detection parameters according to a formula $$DTF(i)=\sum_{m=0}^{M-1} y_i(m)w_i(m)$$

where said $w_i(m)$ is a respective weighting value, said $y_i(m)$ is a channel signal energy value of said channel m at said frame i, and said M is a total number of said channels of said filter bank.

20. The system of claim 19 wherein a recognizer analyzes said endpoint signals and feature vectors from a feature extractor to generate a speech detection result for said speech detector.

21. A method for suppressing background noise in audio data, comprising:

performing a manipulation process on said audio data using a detector that includes a filter bank that generates filtered channel energy by separating said audio data into discrete frequency channels, said detector including a weighting module that weights selected components of said audio data to suppress said background noise, said weighting module generating noise-suppressed channel energy by applying separate weighting values directly to each of said discrete frequency channels of said filtered channel energy, said separate weighting values being related to background noise values of said discrete frequency channels; and controlling said detector with a processor to thereby suppress said background noise.

22. The method of claim 21 wherein said audio data includes speech information.

23. The method of claim 22 wherein said detector comprises a speech detector that includes program instructions which are stored in a memory device coupled to said processor, said speech detector weighting selected said components of said audio data to suppress said background noise.

24. The method of claim 23 wherein said speech information includes digital source speech data that is provided to said speech detector by an analog sound sensor and an analog-to-digital converter.

25. The method of claim 24 wherein said speech detector comprises a noise suppressor, said noise suppressor including a noise calculator, a speech energy calculator, and said weighting module.

26. The system of claim 25 wherein A method for suppressing background noise in audio data, comprising:

performing a manipulation process on said audio data using a detector, said audio data including digital source speech data provided to said speech detector by an analog sound sensor and an analog-to-digital converter, said detector including a filter bank that generates filtered channel energy by separating said digital source speech data into discrete frequency channels, said detector including a speech detector with program instructions that are stored in a memory device, said speech detector including a noise suppressor with a noise calculator, a speech energy calculator, and a weighting module, said speech detector weighting selected components of said audio data to suppress said background noise, said noise calculator calculating background noise values during a silent segment of said audio data, said silent segment being located below an ending noise-calculation threshold that is expressed by the formula:

$$T_e+0.125(T_{er}-T_e)$$

where $T_e$ is an beginning threshold of said audio data and $T_{er}$ is an beginning threshold of a reliable island in said audio data; and controlling said detector with a processor to thereby suppress said background noise.

27. A method for suppressing background noise in audio data, comprising:

performing a manipulation process on said audio data using a detector, said audio data including digital source speech data provided to said speech detector by an analog sound sensor and an analog-to-digital converter, said detector including a filter bank that generates filtered channel energy by separating said digital source speech data into discrete frequency channels, said detector including a speech detector with program instructions that are stored in a memory device, said speech detector including a noise suppressor with a noise calculator, a speech energy calculator, and a weighting module, said speech detector weighting selected components of said audio data to suppress said background noise, said noise calculator calculating background noise values during a silent segment of said audio data, said silent segment being located below an ending noise-calculation threshold that is expressed by the formula:

$$T_s+0.125(T_{er}-T_e)$$

where $T_s$ is a beginning threshold of said audio data and $T_{se}$ is a beginning threshold of a reliable island in said audio data; and controlling said detector with a processor to thereby suppress said background noise.

28. The method of claim 25 wherein said noise calculator derives a channel average background noise value "$N_i(m)$" for a channel m at a frame i by using an iterative equation $$N_i(m)=\alpha N_{i-1}(m)+(1-\alpha)y_i(m)$$

m=0, 1, . . . , M−1 where said $y_i(m)$ is a signal energy during a silent segment of said channel m at said frame i, said M is a total number of said discrete frequency channels, and said $\alpha$ is a forgetting factor.

29. A method for suppressing background noise in audio data, comprising:

performing a manipulation process on said audio data using a detector, said audio data including digital source speech data provided to said speech detector by an analog sound sensor and an analog-to-digital converter, said detector including a filter bank that generates filtered channel energy by separating said digital source speech data into discrete frequency channels, said detector including a speech detector with program instruction s that are stored in a memory device, said speech detector including a noise suppressor with a noise calculator, a speech energy calculator, and a weighting module, said speech detector weighting selected components of said audio data to suppress said background noise, said noise calculator deriving a channel average background noise value "$N_i(m)$" for a channel m at a frame i by using an iterative equation $$N_i(m)=\alpha N_{i-1}(m)+(1-\alpha)y_i(m)$$

m=0, 1, . . . , M−1 where said $y_i(m)$ is a signal energy during a silent segment of said channel m at said frame i, said M is a total number of said discrete frequency channels, and said $\alpha$ is a forgetting factor, said $\alpha$ being equal to 0.985 which is equivalent to a window size of 145 frames; and controlling said detector with a processor to thereby suppress said background noise.

30. A method for suppressing background noise in audio data, comprising:

performing a manipulation process on said audio data using a detector, said audio data including digital source speech data provided to said speech detector by an analog sound sensor and an analog-to-digital converter, said detector including a filter bank that generates filtered channel energy by separating said digital source speech data into discrete frequency channels, said detector including a speech detector with program instructions that are stored in a memory device, said speech detector including a noise suppressor with a noise calculator, a speech energy calculator, and a weighting module, said speech detector weighting selected components of said audio data to suppress said background noise, said noise calculator utilizing a non-linear spectrum subtraction procedure that removes a mean value and produces a channel average background noise variance value "$V_i(m)$" for a channel m at a frame i, said channel average background noise variance value "$V_i(m)$" for said channel m at said frame i being calculated using an iterative equation $$V_i(m)=\alpha V_{i-1}(m)+(1-\alpha)|y_i(m)-N_i(m)|$$

m=0, 1, . . . , M−1 where said $y_i(m)$ is a signal energy during a silent segment of said channel m at said frame i, said $N_i(m)$ is a channel average background noise value, said M is a total number of said discrete frequency channels, and said a is a forgetting factor; and controlling said detector with a processor to thereby suppress said background noise.

31. The method of claim 30 wherein said $\alpha$ is equal to 0.985 which is equivalent to a window size of 145 frames.

32. A method for suppressing background noise in audio data, comprising:

performing a manipulation process on said audio data using a detector, said audio data including digital source speech data provided to said speech detector by an analog sound sensor and an analog-to-digital converter, said detector including a filter bank that generates filtered channel energy by separating said digital source speech data into discrete frequency channels, said detector including a speech detector with program instructions that are stored in a memory device, said speech detector including a noise suppressor with a noise calculator, a speech energy calculator, and a weighting module, said speech detector weighting selected components of said audio data to suppress said background noise, said weighting module generating noise-suppressed channel energy by applying separate weighting values to each of said discrete frequency channels of said filtered channel energy, said separate weighting values being related to background noise values of said discrete frequency channels; and controlling said detector with a processor to thereby suppress said background noise.

33. The method of claim 32 wherein said noise-suppressed channel energy "$E_T$" equals a summation of said filtered channel energy from each of said discrete frequency channels "$E_i$" multiplied by a corresponding one of said weighting values "$w_i$".

34. The method of claim 33 wherein said noise-suppressed channel energy "$E_T$" is defined by a formula:

$$E_T=\Sigma w_i{*}E_i$$

i=0, 1, . . . p−1 where said $E_i$ is a channel energy of said discrete frequency channels.

35. The method of claim 32 wherein said weighting module calculates a weighting value "$w_i(m)$" for said channel "i" using a formula $$w_i(m)=1/V_i(m)$$

where "$V_i(m)$" is a channel average background noise variance value for said channel "i" from said filter bank.

36. The method of claim 32 wherein said weighting module calculates a weighting value "$w_i(m)$" for said channel "i" using a formula $$w_i(m)=1/MINV$$

where MINV is a minimum variance of channel background noise, said MINV implementing a saturation limit to reduce a dynamic range of said weighting value "$w_i(m)$" when a channel average background noise variance value "$V_i(m)$" is less than said MINV.

37. The method of claim 36 wherein said MINV is equal to one of a value between 0.0001 and 0.0002, and a value equal to 0.00013.

38. The method of claim 32 wherein an endpoint detector analyzes said noise-suppressed channel energy to generate an endpoint signal.

39. The method of claim 38 wherein said endpoint detector calculates endpoint detection parameters according to a formula $$DTF(i) = \sum_{m=0}^{M-1} y_i(m) w_i(m)$$

where said $w_i(m)$ is a respective weighting value, said $y_i(m)$ is a channel signal energy value of said channel m at said frame i, and said M is a total number of said channels of said filter bank.

40. The method of claim 39 wherein a recognizer analyzes said endpoint signals and feature vectors from a feature extractor to generate a speech detection result for said speech detector.

41. A computer-readable medium comprising program instructions for suppressing background noise by:

performing a manipulation process on said audio data using a detector that includes a filter bank that generates filtered channel energy by separating said audio data into discrete frequency channels, said detector including a weighting module that weights selected components of said audio data to suppress said background noise, said weighting module generating noise-suppressed channel energy by applying separate weighting values directly to each of said discrete frequency channels of said filtered channel energy, said separate weighting values being related to background noise values of said discrete frequency channels; and controlling said detector with a processor to thereby suppress said background noise.

42. A system for suppressing background noise in audio data, comprising:

means for performing a manipulation process on said audio data, said means for performing including a filter bank that generates filtered channel energy by separating said audio data into discrete frequency channels, said means for performing also including a weighting module that weights selected components of said audio data to suppress said background noise, said weighting module generating noise-suppressed channel energy by applying separate weighting values directly to each of said discrete frequency channels of said filtered channel energy, said separate weighting values being related to background noise values of said discrete frequency channels;

means for controlling said means for performing to thereby suppress said background noise.

* * * * *